US008220627B2

(12) United States Patent
DeJesus

(10) Patent No.: US 8,220,627 B2
(45) Date of Patent: Jul. 17, 2012

(54) BANDLESS CABINET PACKAGING DESIGN

(75) Inventor: Louis DeJesus, Geneva, OH (US)

(73) Assignees: Third Dimension Incorporated, Geneva, OH (US); U.S. Corrugated, Inc., Newark, NJ (US)

( * ) Notice: Subject to any disclaimer, the term of this patent is extended or adjusted under 35 U.S.C. 154(b) by 140 days.

(21) Appl. No.: 12/685,419

(22) Filed: Jan. 11, 2010

(65) Prior Publication Data

US 2010/0176014 A1 Jul. 15, 2010

Related U.S. Application Data

(60) Provisional application No. 61/143,469, filed on Jan. 9, 2009.

(51) Int. Cl.
*B65D 85/00* (2006.01)

(52) U.S. Cl. ..... 206/326; 229/87.01

(58) Field of Classification Search ..... 206/326; 229/125.29, 125.26, 222, 144, 166, 87.01
See application file for complete search history.

(56) References Cited

U.S. PATENT DOCUMENTS 1,815,565 A * 7/1931 Hill et al. ..... 229/120.18
1,859,645 A * 5/1932 Anderson ..... 229/125.26
2,393,356 A * 1/1946 Fallert ..... 229/125.26
2,407,463 A * 9/1946 Williams ..... 229/117.16
2,553,840 A * 5/1951 Andre ..... 229/125.21
2,618,429 A * 11/1952 Donnell ..... 229/125.29
2,706,595 A * 4/1955 Fallert ..... 229/125.29
2,718,996 A * 9/1955 Jamieson ..... 229/110
2,741,419 A * 4/1956 Janz ..... 229/125.21
2,766,921 A * 10/1956 Jones et al. ..... 229/103.11
5,722,583 A 3/1998 Focke et al.
6,283,363 B1 9/2001 Focke
2008/0217390 A1 9/2008 Sattel et al.

* cited by examiner

*Primary Examiner* — Jacob K Ackun
*Assistant Examiner* — Jenine Pagan
(74) *Attorney, Agent, or Firm* — Fay Sharpe LLP; James E. Scarbrough

(57) ABSTRACT

A bandless packaging assembly for cabinets includes a top packaging member including a front wall, a back wall and first and second side walls; a bottom packaging member including a front wall, back wall and first and second side walls; at least one side member extending between a first side wall of the top packaging member and a first side wall of the bottom packaging member; wherein the side member includes an upper flap and a lower flap which are received in corresponding slots formed in the top packaging member and the bottom packaging member; and at least one strip extending between front and back walls of the top packaging member and the bottom packaging member. The strip is received by slots formed in the front and back walls of the top packaging member and bottom packaging member.

20 Claims, 13 Drawing Sheets

BANDLESS CABINET PACKAGING DESIGN

CLAIM OF PRIORITY

This application claims priority from U.S. Provisional Application Ser. No. 61/143,469 filed on Jan. 9, 2009, which is hereby incorporated by reference.

BACKGROUND OF THE DISCLOSURE

The present disclosure generally relates a packaging design or system for packaging wooden or metal cabinets or other articles, and more particularly relates to a bandless cabinet packaging design.

The disclosure relates to packages made of stiff, foldable packaging material, such as cardboard. The packages typically include two separate upper and lower boxes, which are each folded out of a single blank with a base wall, front wall, back wall, and side walls for each box. The front, back and side walls are formed of folding flaps which are joined to the base wall.

This disclosure is concerned with the design of boxes which can package large articles such as cabinets. The package is divided, consisting as it does of two separable boxes joined to one another by shrouds, each as a self-contained unit.

The package according to the disclosure is made essentially of relatively thick cardboard material, such as corrugated cardboard. The blank for the manufacture of the package according to the disclosure is of simple design, namely an elongated, essentially square or rectangular shape.

Existing packaging designs require a band or strap to hold the top and bottom box portions together along with the cabinet. Bands which hold the two pieces (upper and lower boxes) of the package together can cause damage to the article or cabinet secured by the packaging design. Bands also can cause a trip hazard at the location where the package is opened.

There exists a need for an improved design which allows a cabinet or other article to be shipped in a cap (upper packaging member) and base tray (lower packaging member) without using conventional bands or banding to hold the package together.

SUMMARY OF THE DISCLOSURE

The present disclosure relates to packaging designs. More particularly, it relates to a bandless packaging design for packaging cabinets or the like.

The improved design allows a cabinet or other article to be shipped in a cap or upper packaging member and base tray or lower packaging member without using conventional bands or banding to hold the package together.

In accordance with one aspect of the disclosure, a bandless packaging assembly for cabinets includes a top packaging member including a front wall, a back wall and first and second side walls; a bottom packaging member including a front wall, back wall and first and second side walls; at least one side member extending between first side walls of the top packaging member and a first side wall of the bottom packaging member; wherein the side member includes an upper flap and a lower flap which are received in corresponding slots formed in the top packaging member and the bottom packaging member; and at least one strip extending between one of the front and back walls of the top packaging member and one of the front and back walls of the bottom packaging member, wherein the strip is received by slots formed in the front or back wall of the top packaging member and the front or back wall of the bottom packaging member.

A bandless packaging assembly for a cabinet including a cap including a base wall, a front wall, a back wall and first and second side walls extending from the base wall; wherein each of the front, back and first and second side walls of the cap includes a crease line between the respective walls and the base wall, wherein each of the front, back and side walls are foldable with respect to the base wall; a base tray including a base wall, a front wall, a back wall and first and second side walls extending from the base wall; wherein each of the front, back and first and second side walls of the base tray includes a crease line between the respective walls and the base wall; a first shroud extending between the first side walls of the cap and base tray; a second shroud extending between the second side walls of the cap and base tray; a first security strip extending between the front walls of the cap and base tray; and a second security strip extending between the back walls of the cap and base tray.

One aspect of the disclosure is sides or shrouds can include a flap at its opposite ends that inserts through a corresponding slot defined in the cap and base members. The flap at each end is then folded back and adhered to the cap or the base via a clip resulting in a very secure package that does not need or use bands or banding.

Another aspect of the present disclosure is security strips or bands also include a flap at opposite ends that inserts through a corresponding slot defined in the cap and base members. The strips or bands help prevent damage or access to the cabinet.

In accordance with another aspect of the present disclosure, a clip is used for securing the side members to the respective top or bottom packaging member.

Another aspect of the disclosure is that adhesive or tape is not required to secure the packaging together.

Still another aspect of the new packaging design is that there can be no damage from a band or banding (as sometimes occurs in conventional band-type packaging), particularly to the article (e.g. a cabinet) secured by the packaging design.

Another aspect of the disclosure is that the lack of bands removes a trip hazard at the location where the package is opened.

Still another aspect of the packaging design is it has a much cleaner look, such as compared to a conventionally banded package.

Still other aspects of the disclosure will become apparent upon a reading and understanding of the following detailed description.

DETAILED DESCRIPTION OF THE DISCLOSURE

Figure 1:
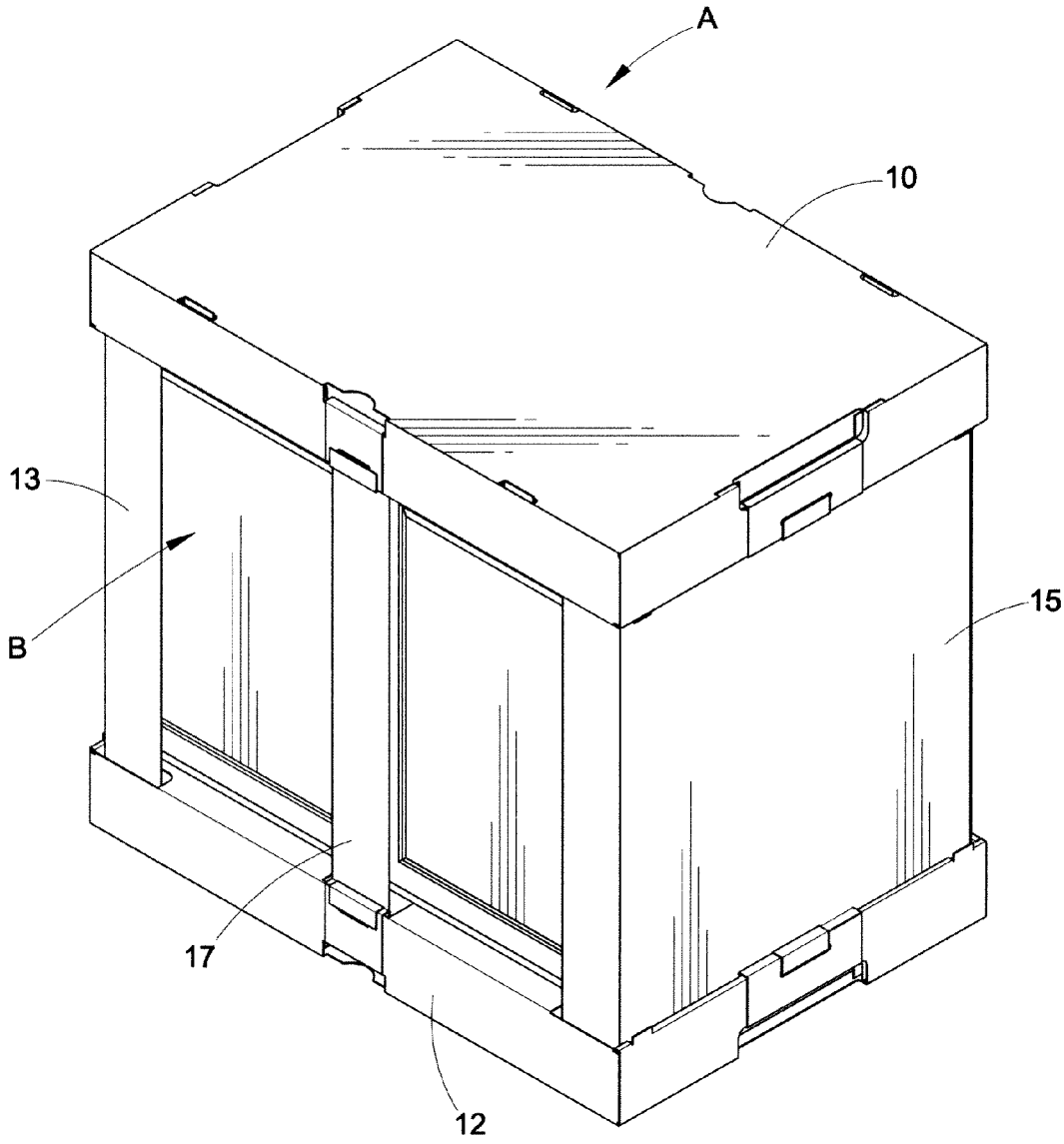
FIG. 1 is a perspective view of a cabinet packaged in a bandless packaging design or system in an assembled state including a top packaging member, a bottom packaging member, two side members and two strips.
Figure 2:
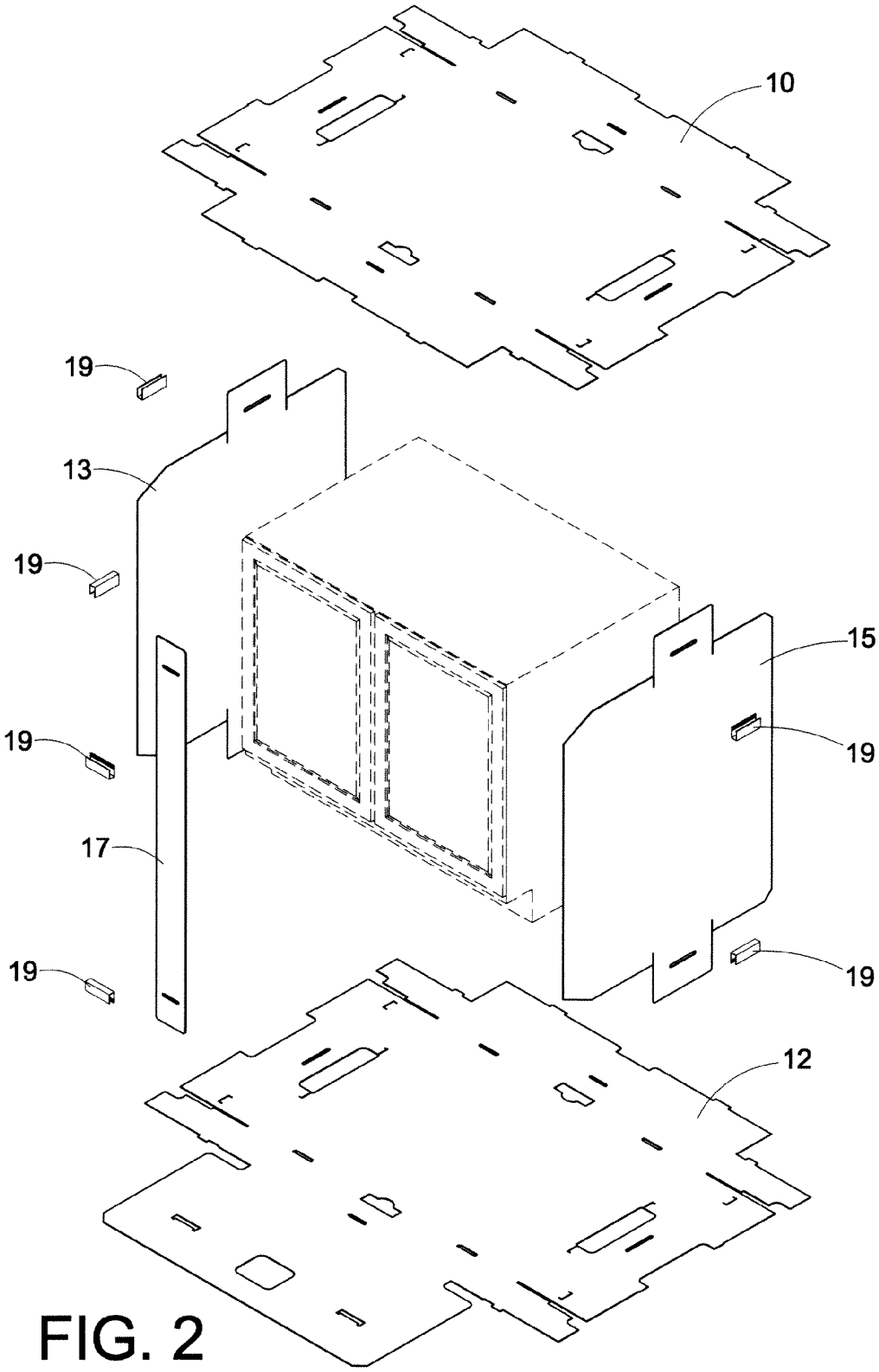
FIG. 2 is an exploded perspective view of a the top packaging member, the bottom packaging member, two side members and two strips in an unfolded state.
Figure 3:
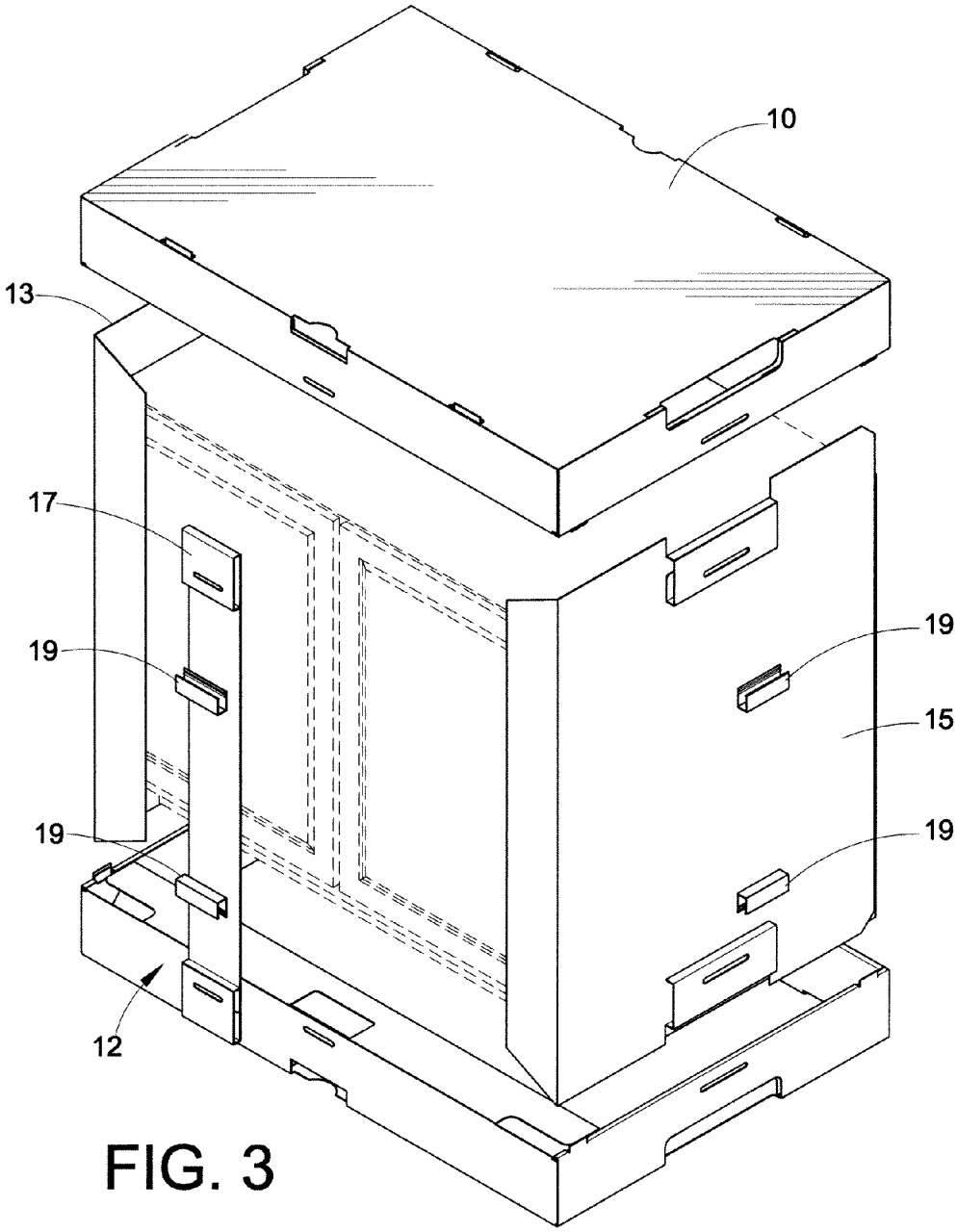
FIG. 3 is an exploded perspective view of the bandless cabinet packaging of FIG. 1.

Referring now to the drawings wherein the showings are for purposes of illustrating one or more exemplary embodiments, FIGS. 1-24 illustrate a bandless packaging system or design A suitable for packaging an article, such as a cabinet B. The improved design allows a cabinet or other article to be shipped in an upper packaging member or cap 10 (shown in an unassembled or unfolded state in FIGS. 2 and 6) and a lower packaging member or base tray 12 (shown in an unassembled or unfolded state in FIGS. 2, 7 and 21-24) without using conventional bands or banding to hold the package together. A pair of shrouds 13, 15 extends between the cap and base tray. Further, at least one security strip 17 extends between the cap and base tray. Clips 19 are used to retain and secure the shrouds and strips in place with respect to the cap and base tray. Since clips are used, no adhesive or glue is required to secure and hold the assembly together.

Figure 6:
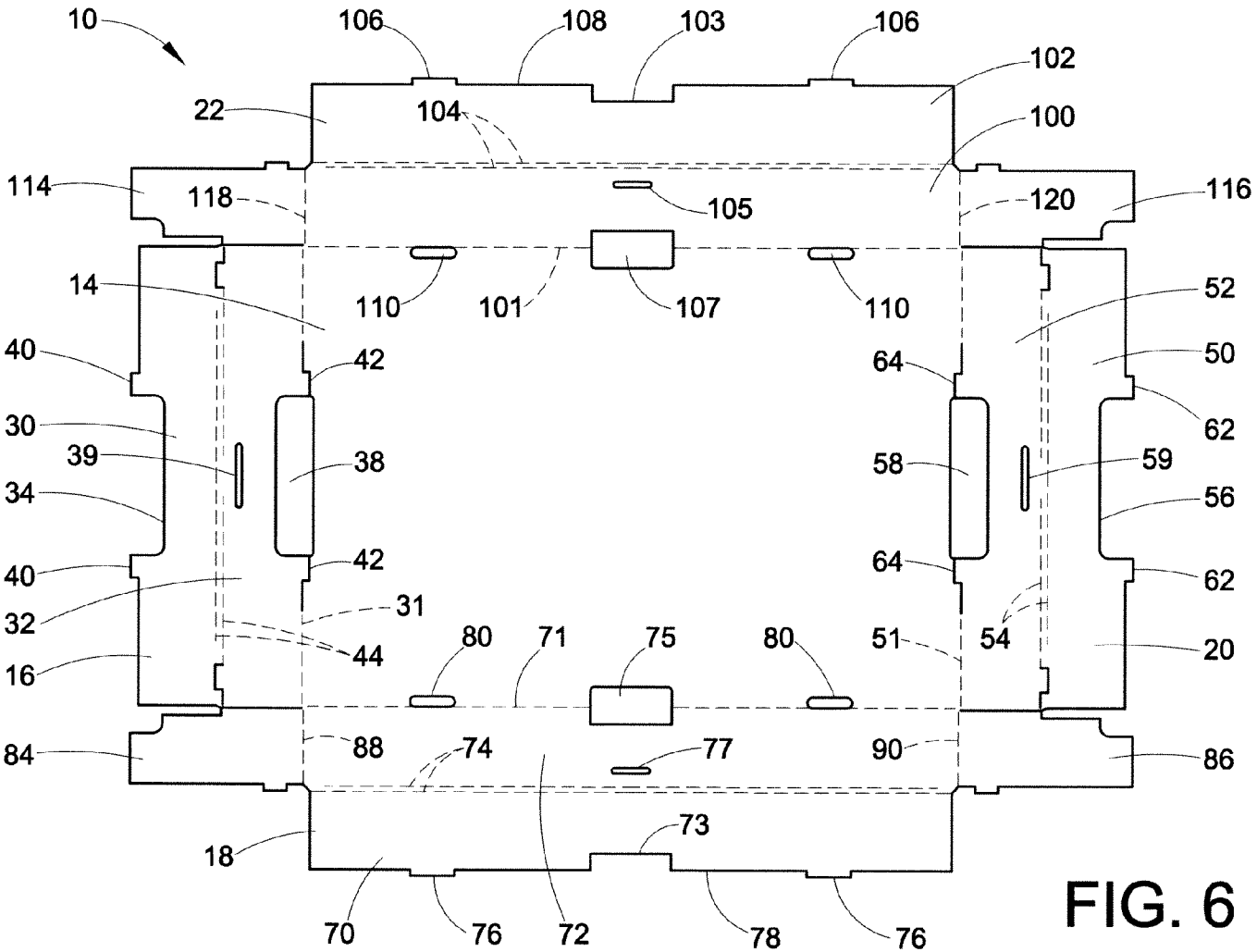
FIG. 6 is a plan view of a top packaging member (or cap) shown in an unfolded state.

Referring now to FIG. 6, cap 10 includes a central area or substantially rectangular top or base wall 14, and a plurality of foldable side walls 16, 18, 20, 22 extending therefrom. Walls 16 and 20 are on opposite sides of the cap and are the short or side walls of the cap. Walls 18 and 22 are on opposite sides of the cap and are the long or front and back walls of the cap.

First side wall 16 is formed by a first portion 30 and a second portion 32 separated by a pair of longitudinally extending perforation or crease lines 44. Portion 30 is also separated by wall 14 by a perforated or crease line 31. Portion 32 is bent upwardly (in FIG. 6) toward wall 14 until portion 32 is perpendicular to wall 14. Portion 30 has an elongated cut-out 34 which aligns with a cut-out 38 in portion 32 when portion 30 is folded over portion 32. Cut-outs 34 and 38 selectively receive the shrouds 13, 15. A slot 39 is formed on portion 32 to receive a retaining clip 19.

A pair of nubs or tabs 40 extend from portion 30 and align with corresponding nubs or tabs 42 formed on portion 32 when portion 30 is folded over portion 32. Perforation or creased lines 44 are formed between the first and second portions 30, 32 to facilitate bending or folding of portion 30 with respect to portion 32.

Similarly, opposite side wall 20 has a first portion 50 and a second portion 52 separated by a pair of longitudinally extending perforated or creased lines 54. Portion 50 is separated by wall 14 by a perforated or crease line 51. Portion 52 is bent upwardly (in FIG. 6) toward wall 14 until portion 52 is perpendicular to wall 14. Portion 50 has an elongated cut-out 56 which aligns with a cut-out 58 in portion 52 when portion 50 is folded over portion 52. Cut-outs 56 and 58 selectively receive the shrouds 13, 15. A slot 59 is formed on portion 52 to receive retaining clip 19.

A pair of nubs or tabs 62 extend from portion 50 and align with corresponding nubs or tabs 64 formed on portion 52 when portion 50 is folded over portion 52.

Perforated or creased line 54 is formed between first portion 50 and second portion 52 to facilitate folding or bending of portion 50 over portion 52.

Referring still to FIG. 6, side wall 18 has a first portion 70 and a second portion 72 separated by a pair of longitudinally extending folded or crease lines 74. Portion 72 is separated by wall 14 by perforated or crease line 71. Wall 72 is folded up (in FIG. 6) toward wall 14 until wall 72 is perpendicular to wall 14. Portion 70 has tabs 76 formed along edge 78 which are received by and locked into corresponding slots 80 formed adjacent portion 72. Cut-outs 73 and 75 are formed in walls 70, 72 which align when wall 70 is folded over wall 72. Cut-outs 73 and 75 together selectively receive one of the security strips 17. Slot 77 is formed in wall 72 to receive clip 19.

Additional arm portions 84, 86 extend from opposite edges 88, 90 of portion 72. Arm 84 is folded up (in FIG. 6) along line or edge 88 and in front of wall 32 when wall 32 and wall 72 are folded upwardly (in FIG. 6). Arm 86 is folded up (in FIG. 6) along line 90 and in front of wall 52 when walls 52 and 72 are folded upwardly (in FIG. 6). Portions 84, 86 serve to provide additional structure and rigidity to wall portions 16, 20.

Side wall 22 also has a first portion 100 and a second portion 102 separated by a pair of longitudinally extending perforated or crease lines 104. Portion 100 is separated by wall 14 by a perforated crease or line 101. Wall 100 is bent up in FIG. 6 toward wall 14 until wall 100 is perpendicular to wall 14. Portion 100 has tabs 106 formed along edge 108 which are received and locked into corresponding slots 110 formed adjacent portion 100 when wall 102 is folded over wall 100.

Additional arm portions 114, 116 extend from opposite edges 118, 120 of portion 100. Arm 14 is folded up (in FIG. 6) in front of wall 32 when wall 100 and wall 32 are folded upwardly. Arm 116 is folded up along line 120 in front of wall 52 when walls 52, 100 are folded up. Portions 114, 116 serve to provide additional structure and rigidity to wall portions 32, 52. Cut-outs 103 and 107 are formed in walls 100, 102 which align when wall 102 is folded over wall 100. Cut-outs 103, 107 selectively receive security strips 17. Slot 105 is formed in wall 100 to receive clip 19.

Figure 7:
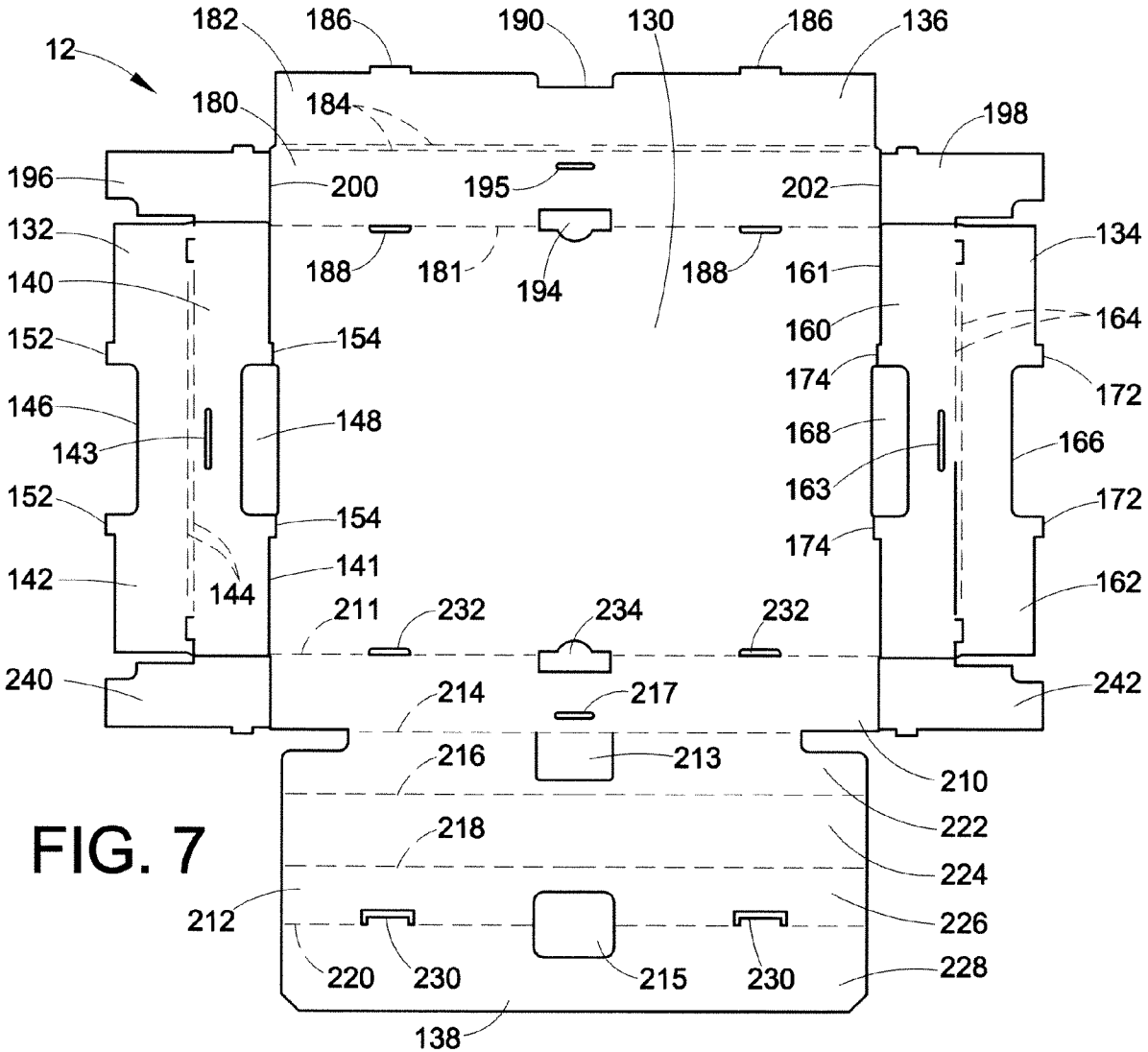
FIG. 7 is a plan view of a bottom packaging member (or base) shown in an unfolded state.

Referring now to FIG. 7, an unfolded base tray 12 is shown. Tray 12 has a main or base wall 130, and foldable side walls 132, 134, 136, 138, extending therefrom. Wall 132 has a first portion 140 and a second portion 142 separated by a pair of longitudinally extending perforated or crease lines 144. Portion 140 is separated by wall 130 by a perforated or crease line 141. Portion 140 is folded up (in FIG. 7) until perpendicular to wall 130. Portion 142 folds over portion 140 along lines 144. Portion 142 has a cut-out 146 which corresponds to cut-out 148 on portion 140 and aligns with cut-out 148 when wall 142 is folded over wall 140. Cut-outs 146, 148 receive one of shrouds 13, 15. Tabs 152 are formed on wall 132 adjacent cut-out 146 and correspond to tabs 154 formed on portion 142. Slot 143 is formed on wall 140 to receive clip 19.

Similarly, wall 134 has a first portion 160 and a second portion 162 separated by a pair of longitudinally extending perforated or crease lines 164. First portion 160 is separated by wall 130 by a perforated or crease line 161. Portion 160 folds up (in FIG. 7) and toward wall 130 until perpendicular to wall 130. Portion 162 folds over portion 160 along lines 164. Portion 162 has a cut-out 166 which corresponds to and aligns with cut-out 168 when wall 162 is folded over wall 160. Cut-outs 166, 168 receive one of shrouds 13, 15. Tabs 172 are formed on wall 162 adjacent cut-out 166 and correspond to tabs 174 formed on portion 162. Slot 163 is formed on wall 160 to receive a clip 19.

Wall portion 136 has a first portion 180 and a second portion 182 which are separated by a pair of longitudinally extending perforated or crease lines 184. Portion 180 is separated by wall 130 by perforated or crease line 181. Portion 180 folds up (in FIG. 7) toward wall 130 until perpendicular to wall 130. Wall portion 182 folds over wall portion 180. Wall portion 182 has tabs 186 which correspond to and are received by mating slots 188 formed adjacent portion 180.

Centrally positioned within portion 182 is a notch 190 which corresponds to and aligns with a cut-out 192 formed in wall portion 180 when wall 182 is folded over wall 180. Notch 190 and cut-out 192 selectively receive a security strip 17. Slot 195 is formed on wall 180 to receive a clip 19.

Furthermore, arm members 196, 198 extend from portion 180 and have crease or perforated lines 200, 202. Wall members 196, 198 fold up (in FIG. 7) and then in front of walls 140, 160, respectively, when walls 180, 140 and 160 are folded up.

Wall 138 has a first portion 210 and a second portion 212 separated from first portion 210 by a perforated or crease line 214. Portion 210 is separated from wall 130 by a longitudinally extending perforated line 211. Portion 210 is folded up (in FIG. 7) until perpendicular to wall 130. Portion 212 has a plurality of longitudinal crease lines 216, 218, 220, which in turn form parallel wall portions 222, 224, 226, 228. Portions 222, 224 and 226 are folded with respect to each other under wall portion 228 along lines 216, 218. Wall portion 228 is positioned under portions 222, 224, 226, and portion 222 is parallel to wall 130, and portions 210, 224 are perpendicular to wall 130 in the assembled configuration. Protrusions 230 extend into mating corresponding slots 232 formed on adjacent portion 210.

A cut-out 234 is formed within wall portion 210 to receive security strip 17. Elongated wall members 240, 242 extend from portion 210 and fold up (in FIG. 7) and in front of walls 140, 160 when wall 210 is folded up. Slots 213 and cut-out 215 align when portions 222, 224, 226 228 are folded to receive security strip 17. Slot 217 is formed in wall 222 to receive clip 19.

Figure 4:
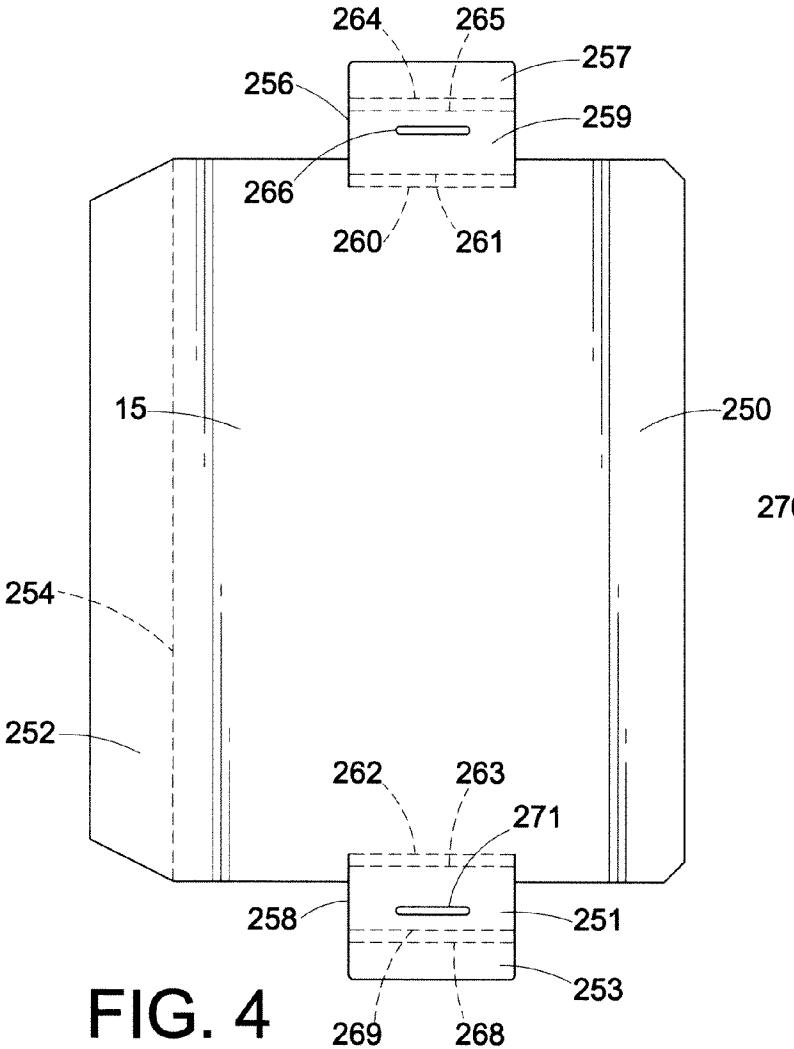
FIG. 4 is a plan view of a right-side shroud member (or side member) shown in an unfolded state that extends between and connects the top packaging member and the bottom packaging member.

Referring now to FIG. 4, a right-side shroud 15 is shown in an unfolded state. Shroud 15 has a first wall portion 250 and a second wall portion 252 which is connected to wall portion 250 by a longitudinally extending perforated or crease line 254. Portion 252 bends 90 degrees with respect to portion 250 along line 254. Portion 250 has a first tab 256 and a second tab 258 extending from opposite edges of the shroud. Tab 256 has first and second portions 257, 259 and a first and second parallel perforated or crease lines 260, 261 and third and fourth parallel crease lines 264, 265. Tab 258 has first and second portions 251, 253 and first crease line 262, a second crease line 263, a third crease line 268 and a fourth crease line 269 all parallel to each other. Tab 256 has an elongated slot 266 which receives clip 19. Similarly, tab 258 has a slot 271 for receiving clip 19.

Figure 5:
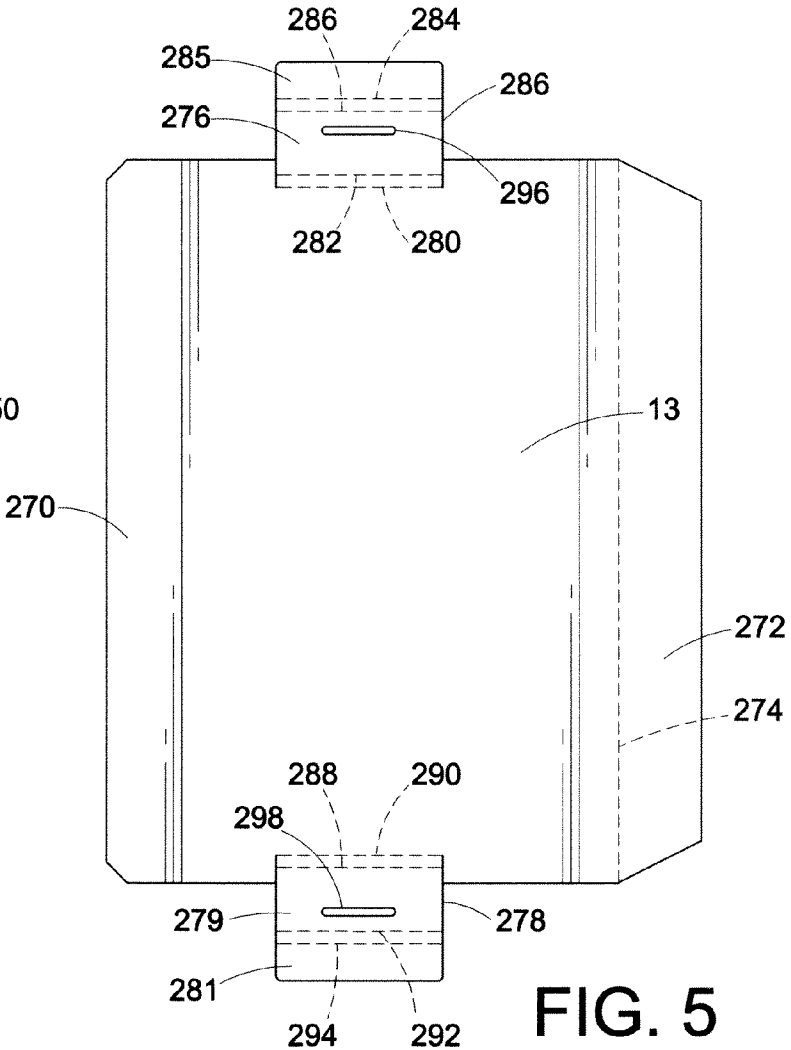
FIG. 5 is a plan view of a left-side shroud member (or side member) shown in an unfolded state that extends between and connects the top packaging member and the bottom packaging member.

Similarly, referring to FIG. 5, a left-side shroud 13 has a first wall portion 270 and a second wall portion 272 which is separated from wall portion 270 by a longitudinally extending perforated or crease line 274. Portion 272 bends 90 degrees with respect to portion 270 along line 274. Portion 270 has a first tab 276 and a second tab 278 extending from opposite edges of the shroud. Tab 276 has first and second portions 283, 285 and first and second parallel crease lines 280, 282 and third and fourth parallel crease lines 284, 286. Tab 278 has first and second portions 279, 281 and first and second parallel crease lines 288, 290 and third and fourth parallel crease lines 292, 294. Tab 276 has an elongated slot 296 which receives clip 19. Similarly, tab 278 has an elongated slot 298 for receiving clip 19.

Figure 8:
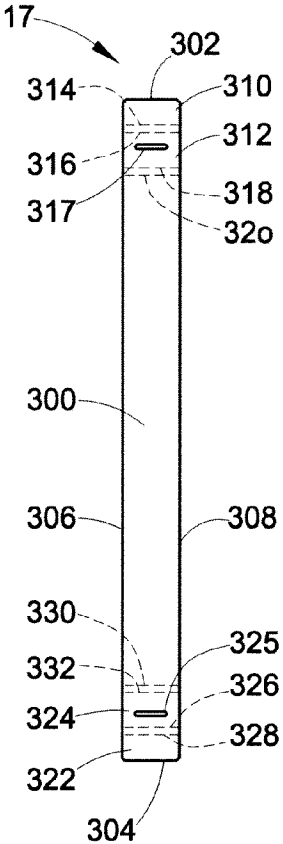
FIG. 8 is a plan view of a security strip in an unfolded configuration.

Referring now to FIG. 8, a security strip 17 is shown. Strip 17 has a main wall 300 and edges 302, 304, 306, 308. Portions 310, 312 are separated by perforated or parallel crease lines 314, 316. Portion 312 is separated from wall 300 by parallel crease lines 318, 320. Similarly, portions 322, 324 are separated by parallel perforated or crease lines 326, 328. Portion 324 is separated by wall 300 by parallel perforated or crease lines 330, 332. Slots 317 and 325 are formed in walls 312, 324, respectively, to receive clips 19.

Figure 9:
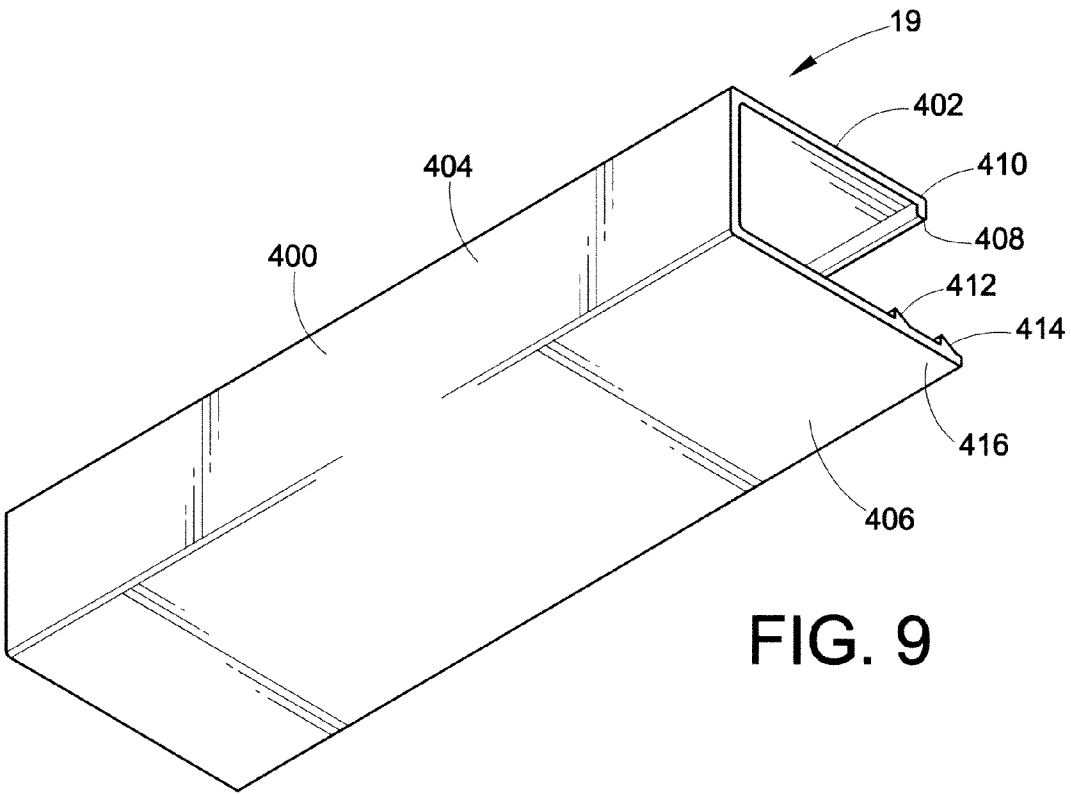
FIG. 9 is a perspective view of a clip for securing the cap or base to the shrouds or strips.

Referring to FIG. 9, a packaging clip 19 is shown. Clip 19, which preferably is fabricated from extruded plastic, includes body 400 having a first member 402, a second member 404 and a third member 406. Members 402 and 406 each are substantially parallel to each other and each extends from member 404, which is substantially perpendicular to members 402, 406. Member 402 has a lip 408 extending from a distal end 410 thereof. Member 406 has two teeth or gripping portions 412, 414 extending from distal end 416. The teeth 412, 414 serve to clamp the clip onto a portion of cap 12 or base tray 14.

To assemble the cap 10, referring again to FIG. 6, wall 72 is folded up 90 degrees along line 71 until perpendicular to wall 14. Wall 70 is folded over wall 72 along lines 74 so tabs 76 engage slots 80 and cut-outs 73, 75 align. Arms 84, 86 are folded 90 degrees up and in front of walls 16, 20.

Wall 100 is folded up 90 degrees along line 101 until perpendicular to wall 14. Wall 102 is folded over wall 100 so tabs 106 engage slots 110 and cut-outs 103, 107 align. Arms 114, 116 are folded up 90 degrees and in front of walls 16, 20.

Wall 32 is folded up 90 degrees along line 31 until perpendicular with wall 14. Then wall 30 is folded over wall 32 along lines 44, and over arms 114, 84, until cut-outs 34, 38 are in alignment, and tabs 40, 42 are in alignment.

Figure 10:
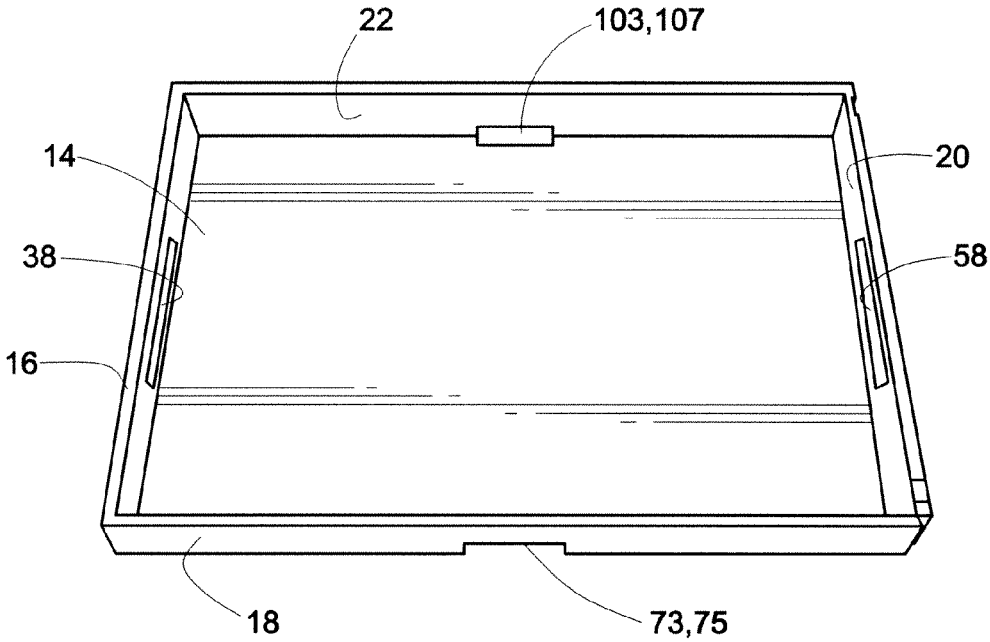
FIG. 10 is a perspective view of a bottom side of the cap in an assembled configuration.
Figure 11:
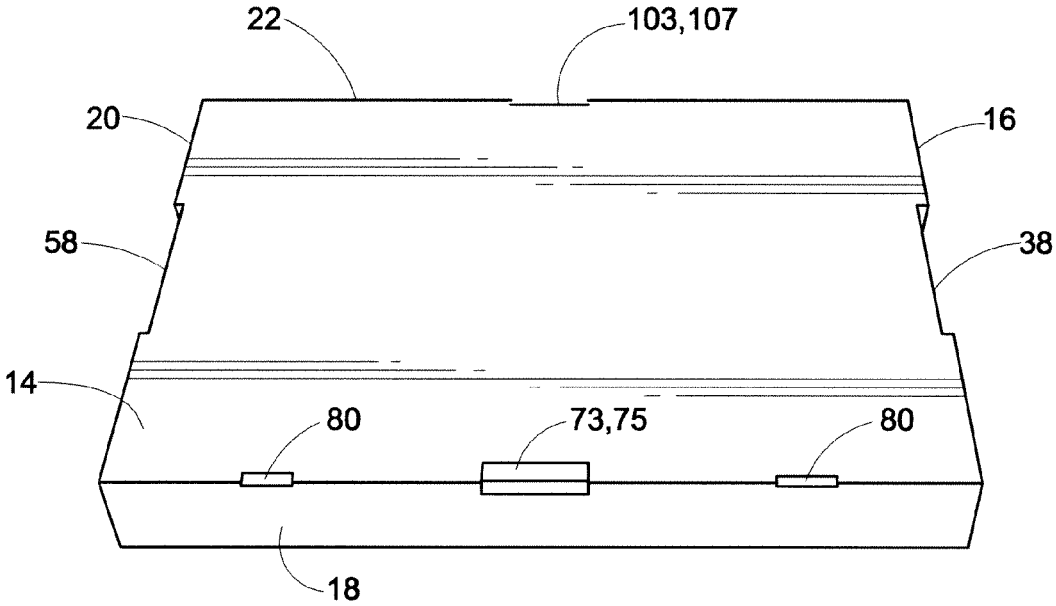
FIG. 11 is a perspective view of a top side of the cap in an assembled configuration.
Figure 12:
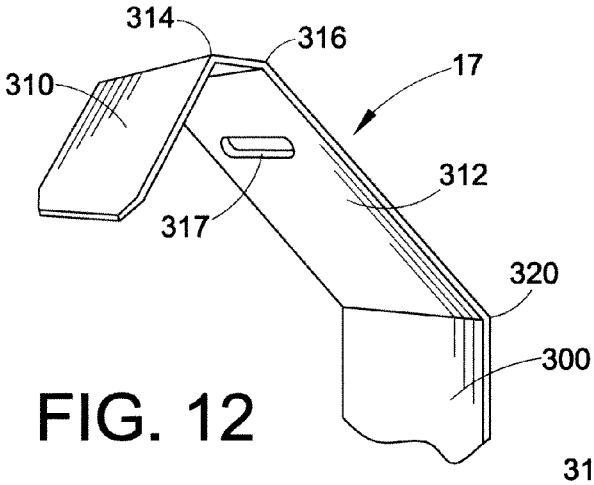
FIGS. 12-15 are perspective views illustrating assembly of a security strip.
Figure 13:
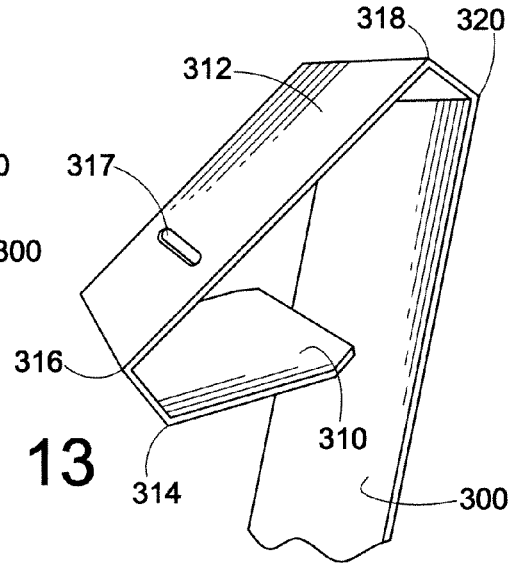
Figure 14:
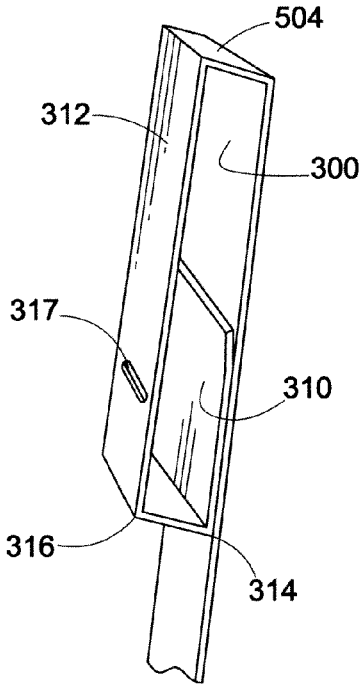
Figure 15:
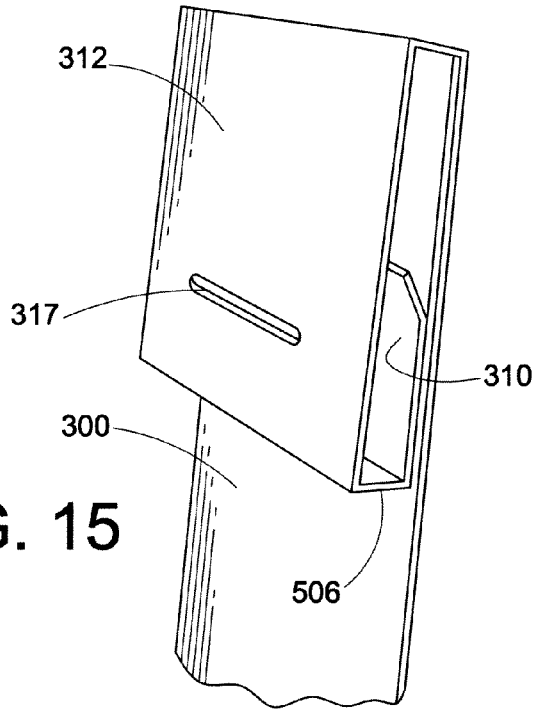
Figure 16:
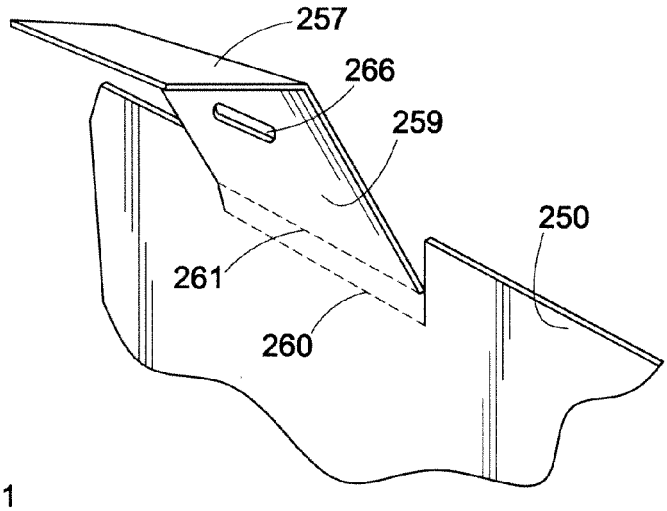
FIGS. 16-18 are perspective views illustrating assembly of a foldable flap for a shroud.
Figure 17:
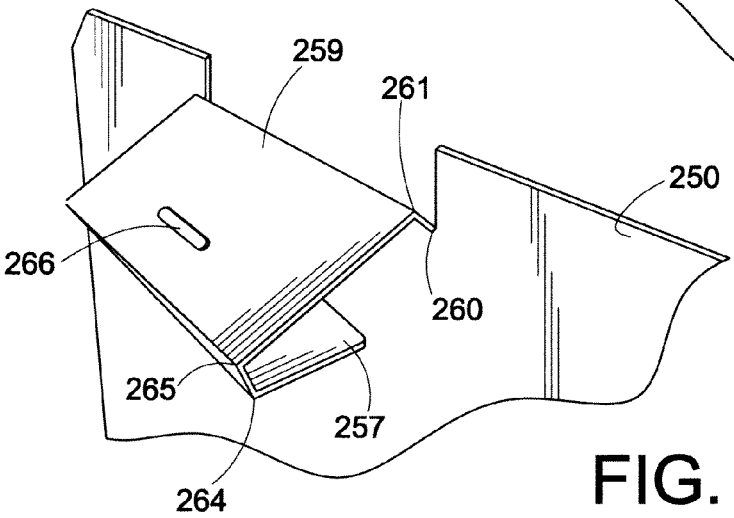
Figure 18:
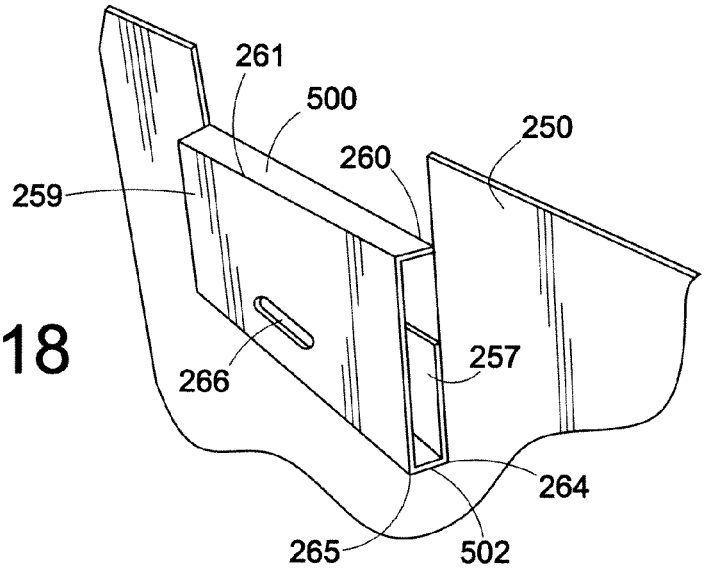

Wall 52 is folded up 90 degrees along line 51 until perpendicular with wall 14. Then wall 50 is folded over wall 52 and over arms 116, 86 until cut-outs 54, 58 are in alignment and tabs 62, 64 are in alignment. Assembled caps are shown in FIGS. 10 and 11.

To assemble the base tray, referring to FIGS. 7 and FIGS. 21-24, wall 180 is folded up 90 degrees along line 181 until perpendicular to wall 130. Wall 210 is then folded up along line 211 until perpendicular to wall 130. Arms 198 and 242 are folded in front of wall 160. Arms 196 and 240 are folded in front of wall 140. Wall 182 is then folded over wall 180 until tabs 186 engage slots 188 and cut-outs 194, 190 align.

Wall 140 is folded up 90 degrees along line 141 until perpendicular to wall 130. Wall 142 is then folded over wall 140 and over arms 196, 240 until cut-outs 146, 148 are in alignment and tabs 152, 154 are in alignment.

Wall 160 is folded along line 161 until perpendicular to wall 130. Wall 162 is then folded over wall 160 and over arms 198, 242 until cut-outs 166, 168 are in alignment and tabs 172, 174 are in alignment.

Figure 19:
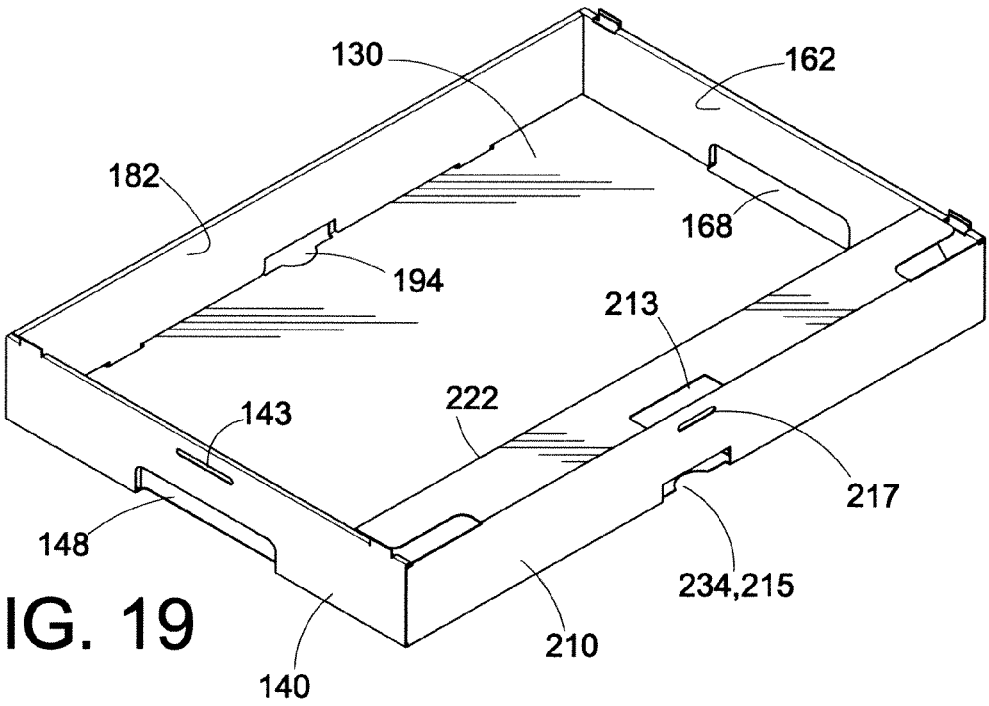
FIG. 19 is a perspective view of a base tray in an assembled configuration.
Figure 20:
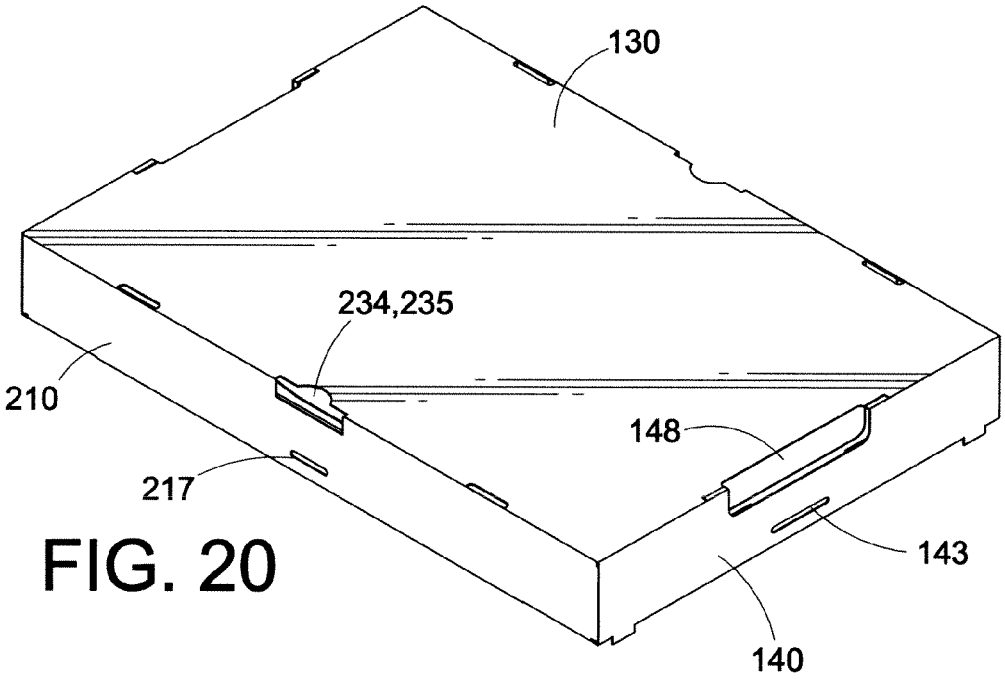
FIG. 20 is a perspective view of the base tray of FIG. 19 in an inverted position.
Figure 21:
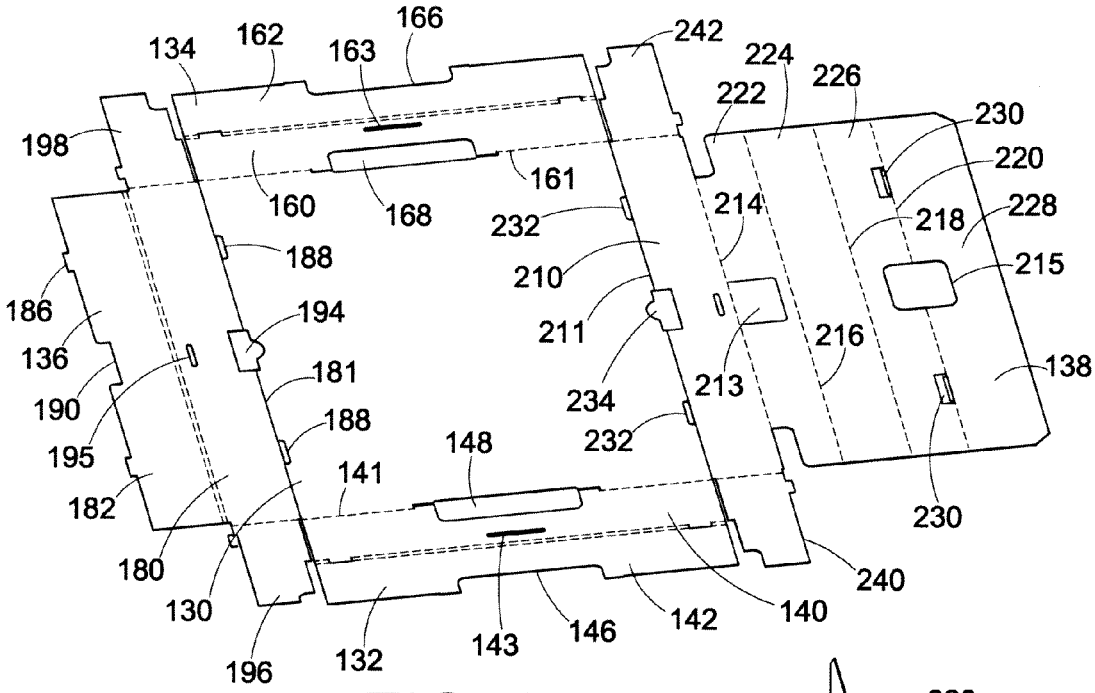
FIG. 21 is a perspective view of a base tray in an unassembled configuration.
Figure 22:
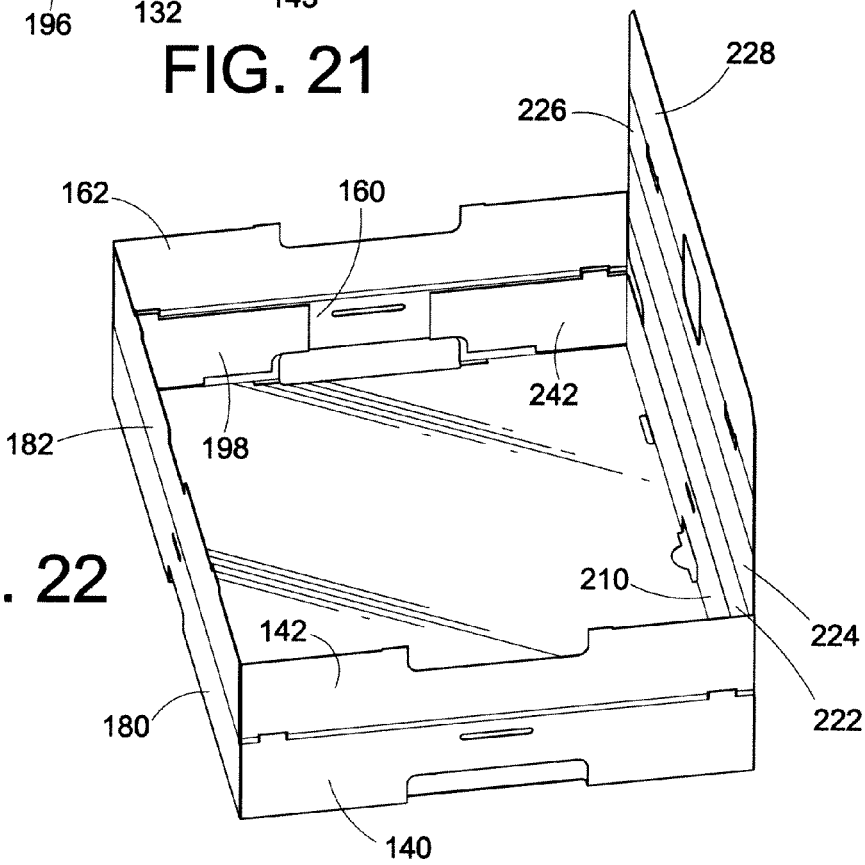
FIG. 22 is a perspective view of a base tray in a partially assembled configuration.
Figure 23:
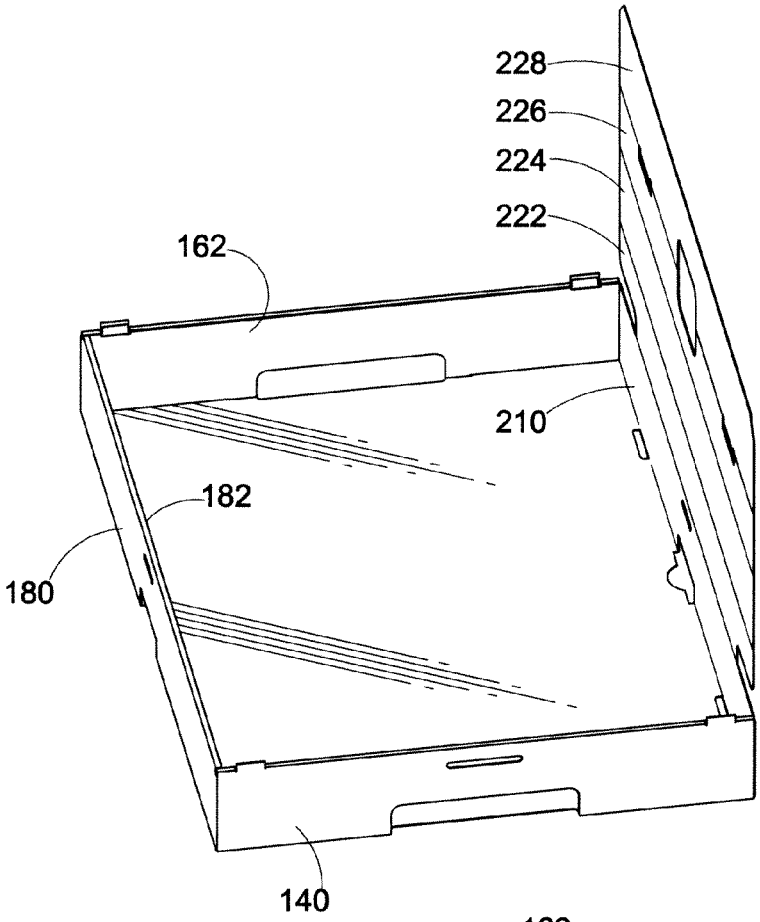
FIG. 23 is a perspective view of a base tray in a partially assembled configuration.
Figure 24:
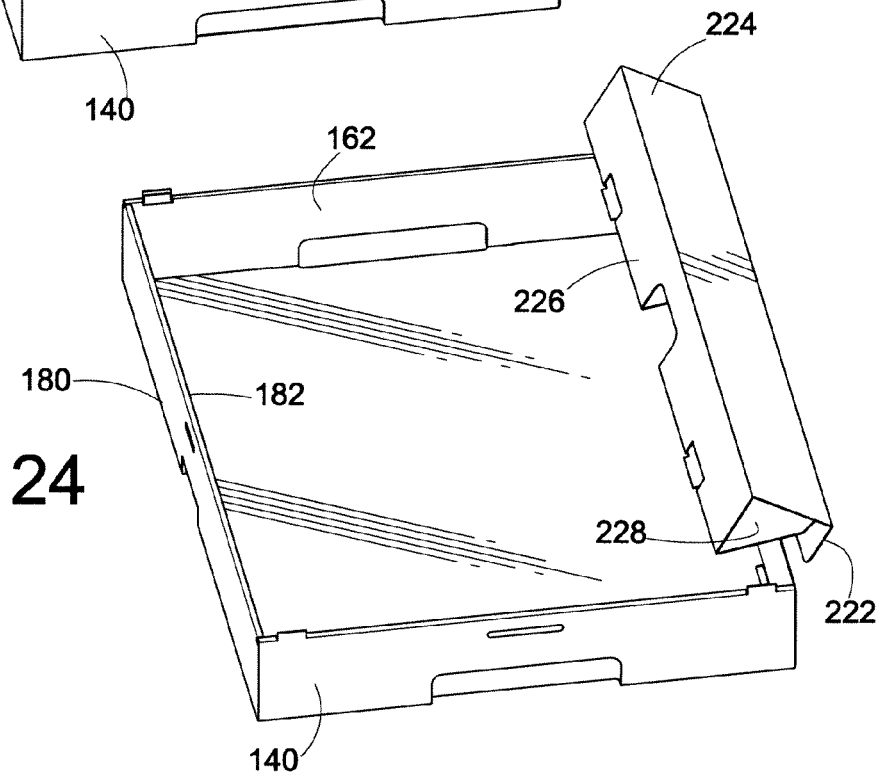
FIG. 24 is a perspective view of a base tray in a partially assembled configuration.

Walls 228, 226, 224 and 222 are folded over or bent along lines 214, 216, 218, 220 until walls 222, 226 are parallel to wall 130 and walls 224 and 210 are parallel to each other and perpendicular to walls 222, 226. Wall 228 is bent under walls 226 and 224. Tabs 230 engage slots 232, and tabs 234, 215 align. An assembled base tray 12 is shown in FIGS. 19 and 20.

Referring now to FIG. 4 and FIGS. 16-18, a right-side shroud or side member 15 is folded as follows: Portion 259 is bent or folded down along line 260. Then portion 259 is bent along line 261 until portion 259 is parallel to and spaced apart from wall 250 forming edge 500. Portion 257 is then bent along line 265 and then along line 264 so that portion 257 is parallel and underneath or behind portion 259 and adjacent wall 250 forming edge 502.

Similarly, portion 251 is bent or folded up along line 262. Then, portion 251 is bend along parallel line 263 so the portion 251 is parallel to wall and spaced apart from portion 250. Portion 253 is bent along line 269 and then along line 260 so that portion 253 is parallel to and underneath portion 251 and adjacent to wall 250. Wall 252 is bent 90 degrees into FIG. 4 with respect to wall 250 along line 254.

Referring now to FIG. 5, a left-side shroud or side member 15 is folded as follows: Portion 283 is bent or folded down along line 280. Then portion 283 is bent along lines 282 until it is parallel to and spaced apart from wall 270. Portion 285 is bent along line 286 and then along line 284 so that portion 285 is parallel to and underneath portion 283 and adjacent wall 270.

Similarly, portion 278 is bent or folded up along line 290. Then, portion 278 is bend along parallel line 288 so the portion 278 is parallel to and spaced apart from wall 270. Portion 281 is bent along line 292 and then along line 294 so that portion 281 is parallel to and underneath portion 278 and adjacent to wall 270. Wall 272 is bent 90 degrees into FIG. 5 with respect to wall 270 along line 274.

Referring to FIG. 8 and FIGS. 12-15, the security strip 17 is bent as follows: Wall 312 is bent downward along line 320, then along line 318 so wall 312 is parallel and spaced apart from wall 300 forming edge 504. Wall 310 is then bent upwardly along line 316, then along line 314 so that wall 310 is parallel to and underneath or behind wall 312, and adjacent to wall 300 forming edge 506.

Wall 324 is bent upward along line 330, then along line 332 so wall 324 is parallel and spaced apart from wall 300. Wall 332 is then bent along line 326, then along line 328 so that wall 322 is parallel to and underneath wall 324, and adjacent to wall 300.

To assemble the bandless package assembly with a cabinet, assembled base tray 12 is placed on a support surface. A cabinet B is inserted into the base tray such that wall 138 forms the front of the assembly. Right-side shroud 15 is inserted into the base tray 12 such that wall 258 is extended through slot 168. Wall 252 is folded perpendicular to wall 250. Wall 251 is folded up along lines 262, 263 to be parallel to walls 160, 162. Then wall 253 is folded downwardly along lines 268, 269 until parallel to walls 160, 162.

Wall 253 is positioned between the shroud and walls 160, 162. A clip 19 is inserted over shroud 15 such that tab 408 extends into slot 271 and teeth 412, 414 engage slot 163.

Left-side shroud 13 is inserted into the base tray 12 such that wall 278 is extended through slot 148. Wall 279 is folded up to be perpendicular to wall 270 along lines 288, 290. Wall 279 is folded up to be parallel to walls 140, 142. Then wall 281 is folded downwardly along lines 292, 294 until parallel to walls 140, 142.

Wall 281 is positioned between the shroud and walls 140, 142. A clip 19 is inserted over shroud 13 such that tab 408 extends into slot 298 and teeth 412, 414 engage slot 143.

The cap 12 is then lowered onto the shrouds 13, 15 and the cabinet, and the base tray 12.

Right-side shroud 15 is inserted into the cap 10 such that wall 256 is extended through slot 58. Wall 259 is folded perpendicular to wall 250. Wall 259 is folded up to be parallel to walls 50, 52 along lines 260, 261. Then wall 257 is folded downwardly along lines 264, 265 over walls 50, 52 until parallel to walls 50, 52 along lines 260, 261.

Wall 257 is positioned between the shroud and walls 50, 52. A clip 19 is inserted over shroud 15 such that tab 408 extends into slot 266 and teeth 412, 414 engage slot 59.

Left-side shroud 13 is inserted into the cap 10 such that wall 276 is extended through slot 38. Wall 272 is folded perpendicular to wall 270. Wall 283 is folded up along lines 280, 282 to be parallel to walls 30, 32. Then wall 285 is folded downwardly over walls 30, 32 along lines 284, 286 until parallel to walls 284, 286.

Wall 285 is positioned between the shroud and walls 30, 32. A clip 19 is inserted over shroud 13 such that tab 408 extends into slot 296 and teeth 412, 414 engage slot 39.

To install the security strips 17 onto the cap and base tray, wall 324 of the strip is inserted into slot 213 and slots 214, 234 of wall 222 of the base tray. Then wall 324 is folded upwardly along line 330, then upwardly along line 332 until wall 324 is parallel to wall 210 and outside wall 210. Wall 322 is folded downwardly along line 326 then line 328 until wall 322 is parallel to wall 210 and wall 210 is positioned between wall 324 and wall 322.

Clip 19 is inserted over walls 322, 324 and 210 and tab 408 is inserted into slot 325 to lock the clip into place. Teeth 412, 414 engage slot 217.

Upper end of the strip is installed onto the cap as follows: Wall 312 is inserted through slot 107, 103 of wall 14. Wall 312 is folded downwardly along line 320, then along line 318 until parallel and outside from wall 100. Then wall 310 is folded upwardly along line 316, then along line 314 until wall 310 is parallel to wall 312 and wall 100 is positioned between wall 310 and wall 312.

A clip 19 is installed through slot 317, and tab 408 is inserted through slot 317 to lock the clip into place and teeth 412, 414 are inserted into slot 195.

To install a second security strip 17 into the base tray, wall 324 is inserted into slots 194, 190 of walls 180, 182. Then wall 324 is folded upwardly along line 330, then along line 332 until wall 324 is parallel to and outside wall 180. Wall 322 is then folded downwardly along line 326 then line 328 until wall 322 is parallel to wall 180 and wall 180 is positioned between wall 322 and wall 324.

Clip 19 is inserted over walls 322, 324 and tab 408 is inserted into slot 325 to lock the clip into place. Teeth 412, 414 engage slot 194.

Upper end of the strip is installed onto the cap as follows: Wall 312 is inserted through slot 75, 73 of walls 70, 72. Wall 312 is folded downwardly along line 320, then along line 318 until parallel to and outside wall 72. Then wall 310 is folded upwardly along line 316, then along line 314 until wall 310 is parallel to wall 312 and wall 72 is positioned between wall 310 and wall 312.

A clip 19 is installed through slot 317, and tab 408 is inserted through slot 317 to lock the clip into place. Teeth 412, 414 are inserted into slot 77.

Thus, the sides or shrouds and the security strips include a flap at opposite ends that inserts through slots defined in the cap and base members. The flap at each end is then folded back and adhered to the cap or the base resulting in a very secure package that does not use bands or banding. Clips are also used in lieu of tape or adhesives.

One advantage of the new packaging design is that there can be no damage from the bands or banding (as sometimes occurs n conventional band-type packaging), particularly to the article (e.g. a cabinet) secured by the packaging design. In addition, the lack of bands removes a trip hazard at the location where the package is opened. Still further, the illustrated packaging design has a much cleaner look, such as compared to a conventionally banded package.

It will be appreciated that various of the above-disclosed and other features and functions, or alternatives thereof, may be desirably combined into many other different systems or applications. Also, it is to be appreciated that various presently unforeseen or unanticipated alternatives, modifications, variations or improvements therein may be subsequently made by those skilled in the art which are also intended to be encompassed by the present disclosure. The steps discussed in this disclosure can be altered or the sequence can be changed without departing from the scope of the disclosure.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A bandless packaging assembly for cabinets comprising:

a top packaging member comprising a front wall, a back wall and first and second side walls;

a bottom packaging member comprising a front wall, a back wall and first and second side walls;

at least one side member extending between said first side wall of said top packaging member and said first side wall of said bottom packaging member;

wherein said side member comprises an upper flap having a first portion and a second portion and a lower flap having a first portion and a second portion;

wherein said upper flap and lower flap are received in corresponding slots formed in said first side wall of said top packaging member and said first side wall of said bottom packaging member wherein said first and second portions of said upper flap are folded with respect to each other so that said first and second portions of said upper flap are positioned on opposite sides of said first side wall of said top packaging member to retain said top packaging member to said side member;

and wherein said first and second portions of said lower flap are folded with respect to each other so that said first and second portions of said lower flap are positioned on opposite sides of said first side wall of said bottom packaging member to retain said bottom packaging member to said side member; and at least one strip extending between one of said front and back wall of said top packaging member and one of said front and back wall of said bottom packaging member, wherein said strip is received by slots formed in said one of said front and back wall of said top packaging member and said one of said front and back wall of said bottom packaging member.

2. The bandless packaging assembly of claim 1 further comprising a second side member extending between said second side wall of said top packaging member and said second side wall of said bottom packaging member.

3. The bandless packaging assembly of claim 2, wherein said second side member comprises an upper flap and a lower flap which are received in slots formed in said second side wall of said top packaging member and said second side wall of said bottom packaging member.

4. The bandless packaging member of claim 1, further comprising a second strip between one of said front and back walls of said top packaging member and one of said first and back walls of said bottom packaging member, wherein said strip is received in slots formed in said one of said front and back walls of said top packaging member and said one of said front and back walls of said bottom packaging member.

5. The bandless packaging member of claim 1, further comprising a plurality of clips for securing said side members to said first side wall of said top packaging member and to said first side wall to said bottom packaging member.

6. The bandless packaging assembly of claim 1, further comprising a plurality of clips for securing said strip to said one of said front and back walls of said top packaging member and to said one of said front and back walls of said bottom packaging member.

7. The bandless packaging assembly of claim 1, wherein said top and bottom packaging members are made of cardboard.

8. The bandless packaging assembly of claim 1, wherein said side member is made of cardboard.

9. The bandless packaging assembly of claim 1, wherein said strip is made of cardboard.

10. The bandless packaging assembly of claim 5, wherein said clips are made of extruded plastic.

11. The bandless packaging assembly of claim 5, wherein said first and second side walls of said top and bottom packaging members each comprise a slot for receiving one of said clips.

12. The bandless packaging assembly of claim 11, wherein said front and back walls of said top and bottom packaging members each comprises a slot for receiving one of said clips.

13. The bandless packaging assembly of claim 5, wherein said side member comprises slots at opposite ends for receiving one of said clips.

14. The bandless packaging assembly of claim 5, wherein said strip comprises slots at opposite ends for receiving one of said clips.

15. A bandless packaging assembly for a cabinet comprising:

a cap comprising a base wall, a front wall, a back wall and first and second side walls extending from said base wall;

wherein each of said front, back and first and second side walls of said cap comprises a crease line between said respective walls and said base wall, wherein each of said front, back and side walls are foldable with respect to said base wall;

wherein each of said front and back walls of said cap comprises a slot;

a base tray comprising a base wall, a front wall, a back wall and first and second side walls extending from said base wall;

wherein each of said front and back walls of said base tray comprises a slot;

wherein each of said front, back and first and second side walls of said base tray comprises a crease line between said respective walls and said base wall, wherein each of said front, back and side walls are foldable with respect to said base wall;

a first shroud extending between said first side walls of said cap and base tray; a second shroud extending between said second side walls of said cap and base tray;

a first security strip extending between said front walls of said cap and base tray, wherein said first security strip comprises a first and second portion which are folded with respect to one another and are received by one of said slots in said front walls of said cap and said base tray, wherein said first and second portion of said first security strip are positioned on opposite sides of said one of said front walls to secure said first strip to one of said cap and base tray; and a second security strip extending between said back walls of said cap and base tray, wherein said second security strip comprises a first portion and second portion which are folded with respect to one another and are received by one of said slots in said back walls of said cap and said base tray, wherein said first and second portions of said second security strip are positioned on opposite sides of said one of said back walls to secure said second strip to one of said cap and base tray.

16. The bandless packaging assembly of claim 15, further comprising a plurality of clips for securing said first shroud to said first side wall of said cap and to said first side wall to said base tray and securing said second shroud to said second side walls of said cap and said base tray.

17. The bandless packaging assembly of claim 15, further comprising a plurality of clips for securing said first security strip to said front wall of said cap and to said front wall of said base tray and for securing said second security strip to said back wall of said cap and to said back wall of said base tray.

18. The bandless packaging assembly of claim 16, wherein said first side walls of said cap and said base tray each comprises a slot for receiving said first shroud, and said second side walls of said cap and said base tray each comprises a slot for receiving said second shroud.

19. The bandless packaging assembly of claim 16, wherein said first and second shrouds each comprises slots at opposite ends for receiving one of said clips.

20. The bandless packaging assembly of claim 16, wherein said first and second security strips each comprises slots at opposite ends for receiving one of said clips.

* * * * *